United States Patent [19]

Linn et al.

[11] Patent Number: 5,060,794

[45] Date of Patent: Oct. 29, 1991

[54] REMINDER SYSTEM

[76] Inventors: Richard A. Linn, 4237 Thomas Ave. N., Minneapolis, Minn. 55412; Edward J. Goldstein, 4721 Isabel Ave., Minneapolis, Minn. 55406

[21] Appl. No.: 571,993

[22] Filed: Aug. 24, 1990

[51] Int. Cl.[5] ..... A45C 11/32

[52] U.S. Cl. ..... 206/232; 206/38.1; 206/39.4; 206/39.5; 206/447; 206/815

[58] Field of Search ..... 206/37.1, 37.4, 38.1, 206/39, 39.1, 39.3, 39.4, 39.5, 232, 371, 555, 447, 815, 816

[56] References Cited

U.S. PATENT DOCUMENTS

| | | | |
|---|---|---|---|
| D. 201,016 | 5/1965 | Holland . | |
| D. 221,118 | 7/1971 | Chambers . | |
| D. 293,287 | 12/1987 | Cauque et al. . | |
| D. 300,582 | 4/1989 | Hodge . | |
| 710,442 | 10/1902 | Downie | 206/815 |
| 806,985 | 12/1905 | Mallory | 206/39.5 |
| 912,110 | 2/1909 | Gill | 206/39.5 |
| 912,905 | 2/1909 | Sims | 206/39.5 |
| 1,066,129 | 7/1913 | Manasse . | |
| 1,658,496 | 2/1928 | Qvarnstrom . | |
| 1,916,119 | 6/1933 | Schwartz et al. | 206/815 |
| 2,195,042 | 3/1940 | Wishinsky . | |
| 2,213,075 | 8/1940 | Ross . | |
| 2,297,285 | 9/1942 | Bledsoe . | |
| 2,572,703 | 10/1951 | Dennis . | |
| 2,628,712 | 2/1953 | Ford . | |
| 2,997,168 | 8/1956 | Tall | 206/815 |
| 3,094,799 | 6/1963 | Hines . | |
| 3,466,774 | 9/1969 | Borresen | 206/232 |
| 4,354,601 | 10/1982 | Harrison | 206/232 |
| 4,518,080 | 5/1985 | Ohlson | 206/39 |
| 4,521,981 | 6/1985 | Kasprzycki et al. . | |
| 4,739,877 | 4/1988 | Olsen . | |
| 4,746,018 | 5/1988 | Mueller | 206/447 |
| 4,789,573 | 12/1988 | Jenkinson . | |
| 4,928,814 | 5/1990 | Rondot et al. | 206/447 |
| 4,932,520 | 6/1990 | Ciarcia et al. | 206/232 |

*Primary Examiner*—David T. Fidei
*Attorney, Agent, or Firm*—Jacobson & Johnson

[57] ABSTRACT

A memo pad device having a frame with a recessed cavity for protectively holding a plurality of sheets from a note pad having a reusable adhesive to allow a user to write reminders to themselves, look at them later, do the task and remove either a single sheet or the entire note pad. In one embodiment a memo pad key ring attachment device includes a polymer plastic frame with a hole for a key ring or similar device, a resilient panel which holds a memo pad, the resilient panel being cantileverly attached to the frame, a stack of sheets of paper with reusable adhesive on one end to permit user to attach memo pad to panel, a projecting lip attached to the frame which holds the second end of the memo pad in place, allowing the edge of a single sheet to be exposed for removal by flexing resilient panel in one direction, a writing instrument, and a means of frictionally holding the writing instrument to the frame.

6 Claims, 3 Drawing Sheets

REMINDER SYSTEM

FIELD OF THE INVENTION

This invention relates to the field of devices that remind people to do things, and more specifically, reminding devices with replaceable note pads.

BACKGROUND OF THE INVENTION

As long as time can remember, people have been forgetting things. The present invention of a memo pad key ring attachment device solves the problem of important things being left undone because people forgot to do them. In the prior art, there are several patents showing devices hooked to a key ring including: Hines U.S. Pat. No. 3,094,799, Ford U.S. Pat. No. 2,628,712, Hodge U.S. Pat. No. Des. 300,582, Jenkinson U.S. Pat. No. 4,789,573, Holland U.S. Pat. No. Des. 201,016, and Dennis U.S. Pat. No. 2,572,703. However, none of these inventions are helpful in reminding the user to do something. The prior art of Ross U.S. Pat. No. 2,213,075 and Wishinsky U.S. Pat. No. 2,195,042 do remind the user of their license plate numbers, they do not have the versatility and the reusability of the present invention. The Qvarnstorm U.S. Pat. No. 1,658,496 is a small box for containing things like cards, licenses and stamps. Prior art U.S. Pat. No. Des. 293,287 is a design for a key chain, watch, miniature flashlight and photograph holder. It does function to remind an individual of the person or place in the photograph, but again, has little reusability and convenience for use as a day to day reminding device. Two other pieces of prior art which show an invention attached to a key chain are Manasse U.S. Pat. No. 1,066,129 and Bledsoe U.S. Pat. No. 2,297,285. The former is a kind of key ring address book. While it could serve as a device for reminding a user of things, the sheets are pre-punched and pre-cut to fit the case, making it inconvenient to get that certain type of paper, and a cover must be used to protect the sheets, unlike the present invention, where the sheets are exposed and yet protected by the device itself. The latter piece of prior art is a personally embossed key chain with the user's name imprinted on the front.

None of the listed art utilized the capabilities of a combination key ring and memo pad of the present invention. It would be desirable to have a compact memo device (for convenience and the actual reminders) attached to a key chain for "on the go" immediate accessibility that is easy to refill and reuse and permits the user to not only carry the reminder note but to post the note on a particular location.

DESCRIPTION OF THE PRIOR ART

U.S. Pat. No. 4,789,573 is a key ring attachment that produces moire patterns when tilted;

U.S. Pat. No. Des. 293,287 is a combination key ring flashlight, photograph holder and chronometer;

U.S. Pat. No. 1,658,496 is a receptacle for carrying cards, licenses, receipts and the like in a pocket of personal clothing;

U.S. Pat. No. 1,066,129 is a key ring and note or address book concealed in a compartment which is opened by means of hinges;

U.S. Pat. No. Des. 201,016 is a combination key, match book holder;

U.S. Pat. No. Des. 221,118 is a key tag with a hollow interior slot and a clear plastic piece on the front face for viewing the interior tag;

U.S. Pat. No. Des. 2,572,703 is a combination key chain and religious momento device;

U.S. Pat. No. 2,195,042 is a combination key tag and miniature license plate with small removable pieces for the license plate;

U.S. Pat. No. 3,094,799 is a combination key ring and key ring loss prevention device. The loss prevention device consists of a small plastic compartment which can be pryed open. Inside the compartment lies an addressed label with postage ready to be mailed;

U.S. Pat. No. 2,628,712 is a combination key check, I.D. tag, matchbook holder;

U.S. Pat. No. Des. 300,582 is a combination key ring and mirror or picture frame support;

U.S. Pat. No. 2,213,075 is a combination key tag and miniature license plate, with the plate being a small stamped metal piece; and U.S. Pat. No. 2,297,285 is a combination name tag or card holder key chain.

BRIEF SUMMARY OF THE INVENTION

The present invention comprises a frame with a recessed cavity for protectively holding a plurality of sheets from a note pad having a reusable adhesive to allow a user to write reminders to themselves, look at them later, do the task and remove either a single sheet or the entire note pad. In one embodiment the invention comprises a memo pad key ring attachment device comprising a polymer plastic frame with a hole for a key ring or similar device, a resilient panel which holds a memo pad, the resilient panel being cantileverly attached to the frame, a stack of sheets of paper with reusable adhesive on one end to permit user to attach memo pad to panel, a projecting lip attached to the frame which holds the second end of the memo pad in place, allowing the edge of a single sheet to be exposed for removal by flexing resilient panel in one direction, a writing instrument, and a means of frictionally holding the writing instrument to the frame. This device allows a user to use the writing instrument to write a reminder to themselves, and after their objective is completed, they can remove the used sheet to find a new one ready.

DESCRIPTION OF THE PREFERRED EMBODIMENT

Figure 1:
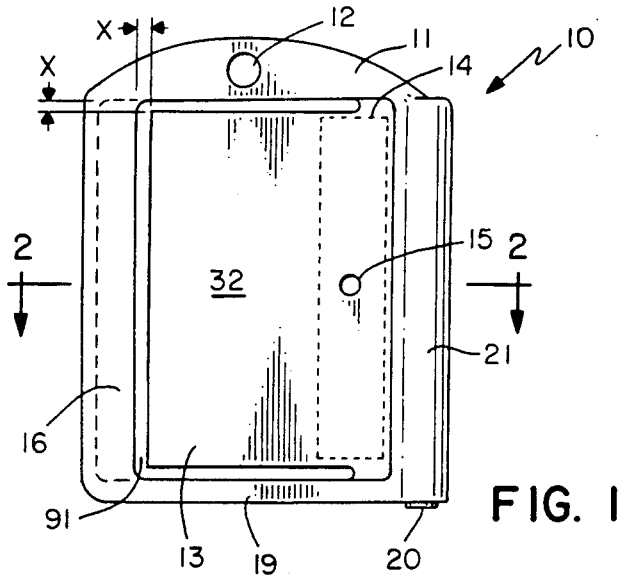
FIG. 1 is a top view of the memo pad key ring attachment.

Referring to FIG. 1, reference numeral 10 generally designates the frame of a one piece memo pad key ring attachment device constructed from a partially flexible polymer plastic. Frame 10 includes a flat end member 19, and a curved end member 11 having a hole 12. Hole 12 permits a user to fasten a key ring to end member 11. End member 11 connects to a side piece 16. Side piece 16 attachs to flat end piece 19, and end piece 19 attachs to a side piece 21, making a plastic rectangular frame consisting of end member 11 and 19, and side pieces 16 and 21.

Extending outward and attached to the bottom portion of side piece 21 to form an attachment means for a note pad, is a resilient panel 13 having a note pad attachment region 14, which is a smooth, flat surface for temporarily attaching an adhesive region of a note pad containing a plurality of sheets of paper thereto.

Note pads are available that have a reusable adhesive located along a portion of one end of the note pad. Generally, the plurality of sheets of paper comprise a stack of individual sheets of paper with a reusable adhesive located in a rectangular strip along one end of one side of each sheet of paper. These note pads allow a user to remove a single sheet from the note pad and temporarily attach the note pad to another object. Such reminder notes pad are commercial available and are sold under the trademark Post-it Notes TM.

Panel 13 also has a small hole 15 in the middle of region 14 so that a user can detach a note pad using a pencil tip or similar device. Resilient panel 13 extends outward from member 21 in a cantilevered manner. A U-shaped slot 91 extends around resilient panel 13 to provide clearance for bending resilient panel 13 free of members 16, 19, and 11. Resilient panel 13 is made of the same polymer plastic as the previously stated pieces, but is sufficiently thin so it is able to bend and flex in response to finger pressure. Region 14 for attaching a stack of note pads thereto is at one end of resilient panel 13 and remains relatively straight as resilient panel 13 flexes in response to pressure from the user thereby minimizing forces that may cause the adhesive from the note pad to pull free of region 14 as the user flexes panel 13.

Implanted in side piece 21 is a small writing pen 20 which is frictionally held in place in member 21.

Figure 2:
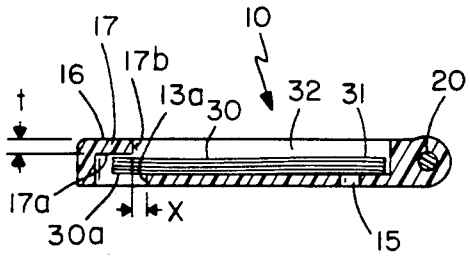
FIG. 2 is a side sectional view taken along lines 2—2 of FIG. 1.
Figure 3:
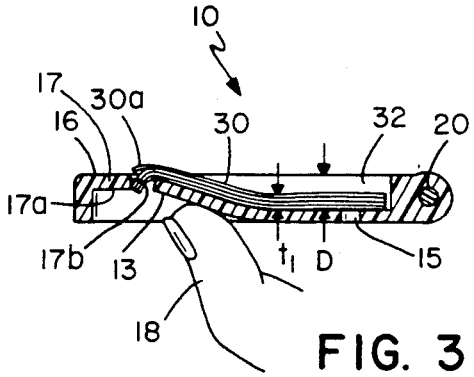
FIG. 3 is a side sectional view taken along lines 2—2 of FIG. 1 showing operation of the resilient panel.

Referring to FIG. 2, reference numeral 10 generally denotes memo pad key ring attachment device from a side sectional view. Note pad 30 comprises a plurality of sheets of paper adhesively fastened to each other. Note pad 30 is located in a pad protecting recess 32 formed by panel 13 and frame members 11, 16, 19 and 21. The height between top of resilient panel 13 and bottom of an overhanging lip 17 of side piece 16 is equal to t. The top sheet of note pad 50 is located below the top surface of members 16, 19, 21, and 11. Typically t should be sufficiently large so that the top most sheets of the paper on note pad 30 remain below the top surface of frame 10. The letter x denotes the clearance distance between an end 13*a* of resilient panel 13 and an end 17*b* of overhanging lip 17. The clearance x is sufficiently large enough so that a user can flex resilient panel 30 upward with note pad 30 thereon. The necessary clearance depends on the thickness of the stack of note pads. With a thicker stack more clearance should be provided and with a thinner stack, less clearance is necessary. In general the clearance should be kept to a minimum in order to insure that there is a backing support surface under note pad 30. FIG. 3 illustrates how the clearance between end 17*b* and resilient panel 13 permits the user to flex resilient panel 13 upward with note pad 30 to isolate a single top sheet from note pad 30. Located under lip 17 is a note pad free end retaining surface 17*a* that extends over the free end portion 30*a* of note pad 30 to restrain the free end of note pad from bending or curling upward as the user carries memo pad key ring attachment device in the users pocket or purse. Reference numeral 31 identifies the adhesive region on note pad 30 used to hold the plurality of sheets of paper onto each other and onto the memo pad key ring attachment device 10.

An advantage of the present invention is that a user "on the go" and performing a task can quickly jot down the reminder for a later reminder with a minimum disruption of the users task. That is, if a user is engaged in an involved matter the user may be fearful of forgetting to perform a task at a later time. To eliminate the concern for forgetting the user needs only to reach in his or her pocket and remove the key ring attachment device and write the reminder on the top sheet of note pad 30. If the user wants to remind himself or herself the user can place the key ring attachment device with note pad 30 back in the users pocket for future reference. If the user needs to place a reminder note in a location for others to see the user can easily remove the top sheet of the note pad 30 and temporarily secure the note sheet to a surface to remind another person of performing the task.

FIG. 3 illustrates how a user can remove a single top sheet of paper from the memo pad key ring attachment device. Reference numeral 18 identifies a finger pressing resilient panel 13 in an upward motion thus causing resilient panel 13 to bend and force the edge of top sheet of paper in note pad 30 out of recess 32 and above overhanging lip 17 thus making the top sheet of paper of note pad 30 available for removal. Note the clearance x makes it possible for resilient panel 13 and the free end of note pad 30 to be pushed up to desired position above overhanging lip 17. The distance $t_1$ denotes the height from the bottom of note pad 30 to the top of the same, while distance D is the height between the top of resilient panel 13 and the top of overhanging lip 17. Overhanging lip 17 prevents the non adhesive or free end of note pad 30 from accidently coming off in pocket or purse by preventing the edges of the free end of note pad 30 from catching on the users pocket or purse. Generally the thickness of note pad 30 is such that the individual sheets of note pad 30 remain spaced from the top of the frame in a parallel relationship to panel 13 as illustrated in FIG. 2.

Although a user may want to remove a single sheet of the note pad there may be occasions when a user wants to remove the entire note pad. Reference numeral 15 depicts a hole for the insertion of an object to permit a user to remove entire note pad 30.

Figure 4:
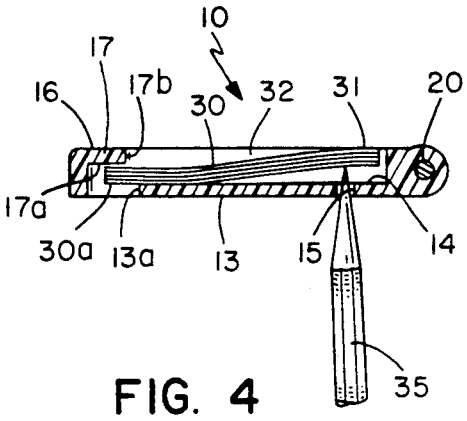
FIG. 4 is a side sectional view taken along lines 2—2 of FIG. 1 showing the removal of a stack of memo sheets.

FIG. 4 shows how a user can remove note pad 30 comprising a stack of a plurality of sheets of paper. Reference numeral 35 identifies a pencil or similar point tipped object extending through hole 15 and pushing the adhesive end of note pad 30 upward and free of surface 14.

Figure 5:
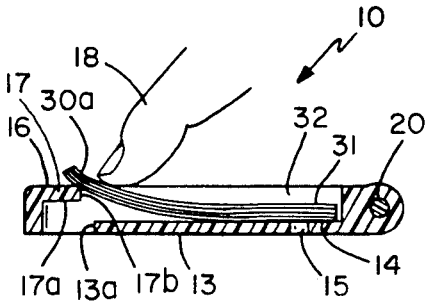
FIG. 5 is a side sectional view taken along lines 2—2 of FIG. 1 showing the insertion of a fresh stack of memo sheets.

FIG. 5 shows a user installing fresh note pad 30 comprised of a plurality of individual sheets of paper into the memo pad key ring attachment device 10. To insert note pad 30 the user places adhesive end portion 31 of note pad 30 onto region 14. The opposite free end of note pad 30 remains suspended above overhanging lip 17. To insert note pad 30 into the recess in memo pad key ring attachment device 10 the user applies downward pressure with finger 18 to forces the free end 30*a* of note pad 30 under overhanging lip 17. Overhanging lip 17 and resilient panel 13 coact to snugly hold the loose or free end of note pad 30 in a non snagging position beneath lip 17.

Figure 6:
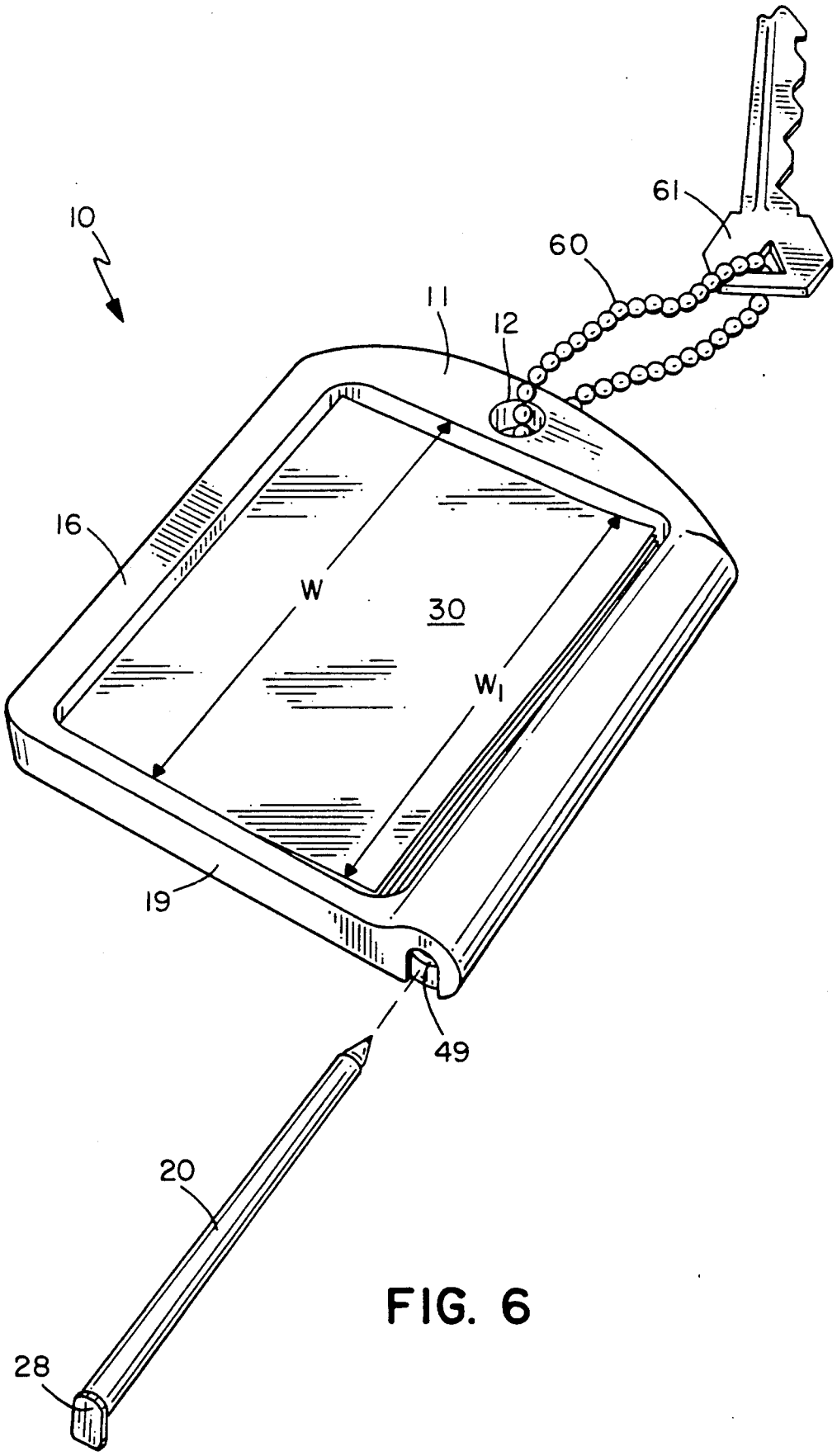
FIG. 6 is an exploded pictorial view of the memo pad key ring attachment device and the writing instrument securing device.

FIG. 6 is a pictorial view of memo pad key ring attachment device 10. The distance $w_1$ is the width of note pad 30 and the measurement w is the distance from the inside of end piece 11 to the inside of end piece 19. More specifically, it is the width between the end units 11 and 19 in the frame. The distance $w_1$ is slightly less than the distance w to permit the sheets of note pad 30 to be freely removed without binding on the edges of memo pad key ring attachment device 10.

Reference numeral 20 identifies in greater detail small writing pen 20 having a fingernail engaging lip 28 and an opening 49 having sidewalls for frictionally gripping the cylindrical barrel of pen 20.

Figure 7:
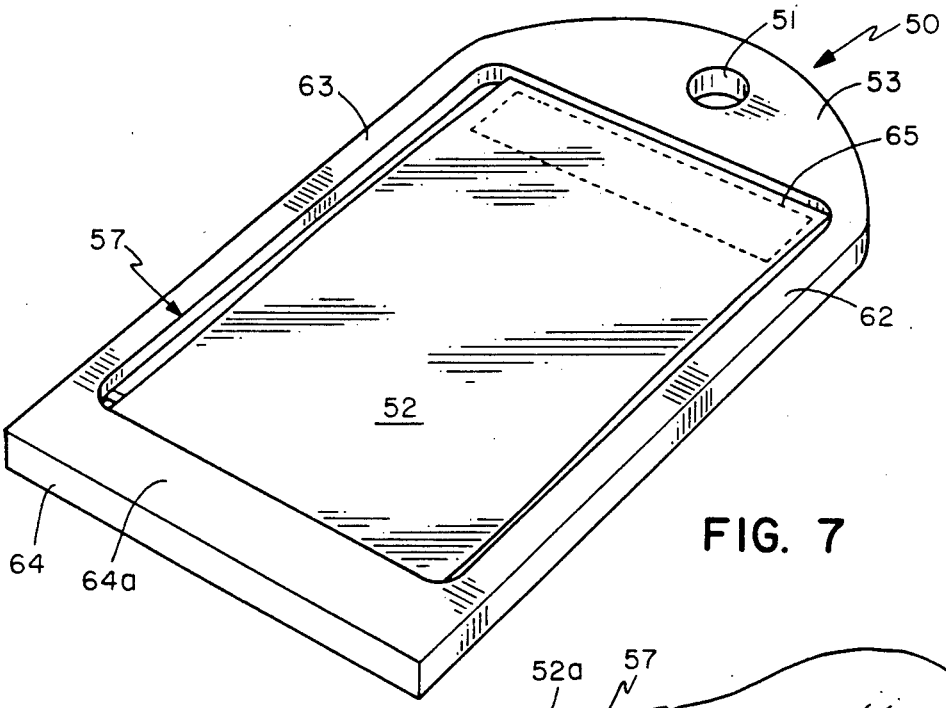
FIG. 7 is a pictorial view of an alternate embodiment.

FIG. 7 shows an alternate embodiment 50 in pictorial view. The embodiment of FIG. 7 is similar to the embodiment of FIG. 1 but lacks the resilient panel for removing a single sheet of material. Alternate embodiment 50 consists of a one piece molded plastic body or frame 53. It includes a rectangular piece of plastic that has been rounded at one end. While body 53 is at a level height, the body has four edges that have been raised to produce a protective recess 57 to hold a note pad 52. Note pad 52 is identical to note pad 30 and comprises a stack of individual sheets of paper secured in place by a strip of reusable adhesive on one end of each sheet of paper. Frame 53 includes a side piece 62, an opposing side piece 63, an end piece 64, and a rounded end piece 65. Rounded end piece 65 has a hole 51. Note pad 52 comprising a plurality of sheets of paper 52 lies in the protective recess 57 in the middle of the alternate embodiment 50. Extending from side to side of memo pad key ring attachment device 50 is a back panel 54 having a flat smooth region 65 for securing note pad 52 with a reusable adhesive thereto.

Figure 8:
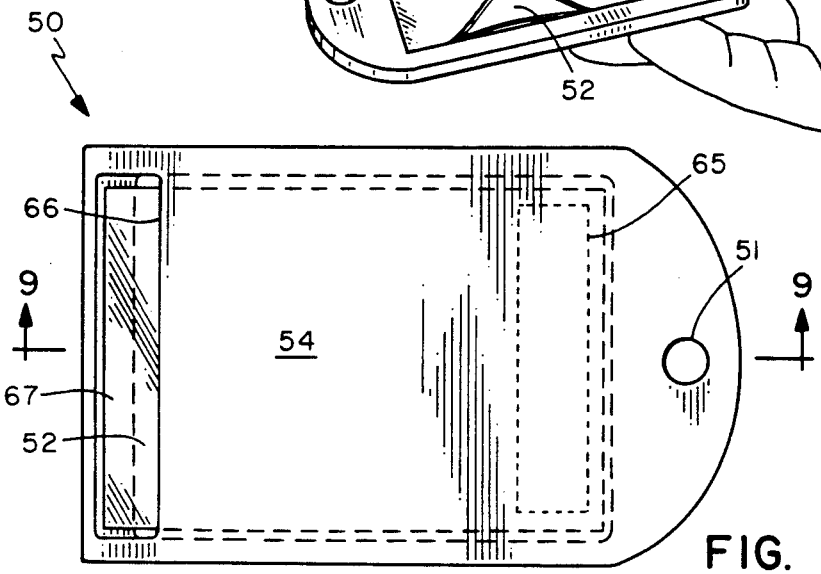
FIG. 8 is a bottom view showing special features of the embodiment of FIG. 7.

FIG. 8 shows a bottom view of the alternate embodiment 50. The bottom panel 54 of the alternate embodiment unlike panel 13 is fixedly mounted to frame 53 and side members 63 and 62. End 66 of panel 54 extends partial toward lip 64*a* but does not extend under lip 64*a*. Reference numeral 67 identifies the free end of note pad 52.

Figure 9:
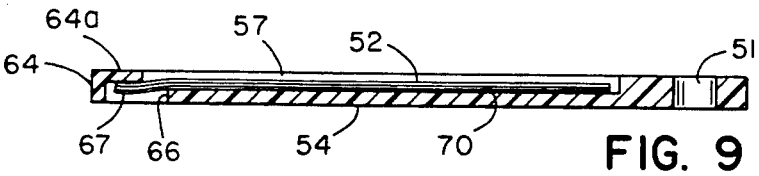
FIG. 9 is a side sectional view of an alternate embodiment taken along lines 9—9 of FIG. 8 displaying a securing device for the free end of a note pad.

FIG. 9 is a side cut-away view of the alternate embodiment 50 illustrating the relationship of note pad 52 to frame 53. Lip 64*a* extends slightly above and over free end 67 of note pad 52 to prevent the top sheets in the free end of note pad 52 from catching in user's pocket or purse. Note the lip 64*a* provides a slight downward bending of end 67 of note pad 52 to thereby provide a frictional force to hold the sheets of note pad 52 in recess 57. Reference numeral 54 shows the bottom portion of the alternate embodiment 50, including hole 51 for fastening a key ring chain thereto.

Figure 10:
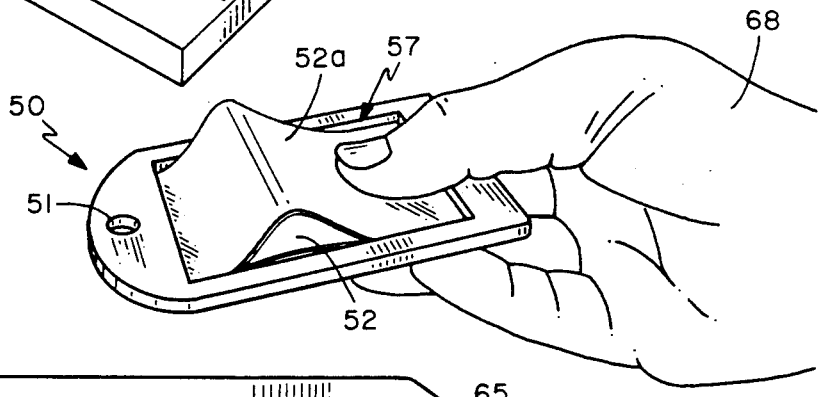
FIG. 10 is a pictorial view showing a user operating the alternate embodiment.

FIG. 10 illustrates how the user can remove a single sheet from memo pad key ring attachment device 50. To remove a top sheet the user places hand 68 with the fingers on panel 54 and the thumb on the top sheet of note pad 52. By frictional engaging the top sheet 52*a* with the users thumb and then pushing the free end of sheet 52*a* laterally toward the adhesive end of note pad 52 the user can slide the free end of top sheet 52*a* out from under lip 64*a* to a position where the user can readily remove top sheet 52*a* from note pad 52.

We claim:

1. A memo pad key ring attachment device to be carried about in a user's pocket or purse with the memo pad key ring attachment device operable for holding a note pad comprising a stack of individual sheets of paper each having an adhesive backing for securing an individual sheet of paper of the stack of individual sheets of paper to an adjacent sheet of paper or to a support surface comprising:

a frame, said frame having a hole therein for engaging a key ring or the like;

a resilient panel, said resilient panel cantileverly connected to said frame, said resilient panel having a region for adhesively fastening a stack of individual sheets of paper thereto, said resilient panel and said frame co-acting to form a protective recess of a depth D for protectively receiving and storing a stack of individual sheets of paper;

a stack of individual sheets of paper, said stack of individual sheets of paper having a first end and a second end, said stack of individual sheets of paper first end having a strip of reusable adhesive located along said first end of said stack of individual sheets of paper to permit a user to fasten said stack of individual sheets of paper to said resilient panel, said stack of individual sheets of paper having a thickness t, said thickness of said stack of individual sheets of paper being less than the depth D of said recess so that an individual sheet of paper in said stack of individual sheets of paper is not accidently scraped off in the users pocket or purse; and a lip mounted on said frame, said lip projecting inward into said recess to thereby hold said second end of said stack of individual sheets of paper within said recess, said lip and said panel spaced sufficiently far from each other to permit said resilient panel with a stack of individual sheets of paper to be flexed in a first direction to force said second end of said stack of individual sheets of paper above said lip to permit a user to remove an individual sheet of paper from said stack of individual sheets of paper by forcing at least one end of said individual sheets of paper in said stack of individual sheets of paper out of said recess so that a user can remove a sheet of said stack of individual sheets of paper to expose an unused sheet of paper for a user to write a reminder note thereon.

2. The memo key ring pad attachment device of claim 1 wherein said frame includes means for supporting a writing instrument therein.

3. The memo key ring pad attachment device of claim 2 wherein said means for supporting a writing instrument includes a surface for frictional engaging a writing instrument and said memo key ring pad attachment device includes a writing instrument for frictional mounting in said key ring pad attachment device.

4. The memo key ring pad attachment device of claim 1 wherein said frame is one piece.

5. The memo key ring pad attachment device of claim 4 wherein said frame comprises a polymer plastic.

6. The memo key ring pad attachment device of claim 1 wherein said resilient panel includes an opening in said region for fastening a stack of individual sheets of paper thereto to permit a user to insert an instrument through said opening to remove the stack of individual sheets of paper therefrom.

* * * * *